United States Patent [19]

Pullig, Jr.

[11] Patent Number: 4,877,085

[45] Date of Patent: Oct. 31, 1989

[54] MANUALLY OPERATED SPEAR APPARATUS

[76] Inventor: Joe G. Pullig, Jr., 104 Reeder Rd., Bossier City, La. 71112

[21] Appl. No.: 289,830

[22] Filed: Dec. 27, 1988

[51] Int. Cl.[4] ..... E21B 31/00

[52] U.S. Cl. ..... 166/98; 294/86.34

[58] Field of Search ..... 166/55.1, 98, 158, 178, 166/301, 312, 376; 294/86.1, 86.25, 86.34

[56] References Cited

U.S. PATENT DOCUMENTS

| | | | |
|---|---|---|---|
| 2,879,849 | 3/1959 | Le Dus, Sr. | 294/86.34 |
| 3,070,176 | 12/1962 | Le Bus, Sr. et al. | 294/86.34 |
| 3,356,141 | 12/1967 | Kline | 166/217 X |
| 3,747,674 | 7/1973 | Murray | 166/98 |

*Primary Examiner*—William P. Neuder

*Attorney, Agent, or Firm*—John M. Harrison

[57] ABSTRACT

A manually operated spear apparatus for engaging and washing over objects such as pipe lodged in a well bore, which spear apparatus includes a landing joint or sleeve as a carrying vessel that is adapted for attachment to one or more strings of wash-over pipe and a spear apparatus fitted with a set of lugs and a set of slips and located inside the landing joint, wherein the spear apparatus is adapted to engage the jammed pipe and selectively allow the landing joint and wash-over pipe to slide past the spear apparatus by operation of the lugs during the wash-over operation and engage the wash-over pipe by operation of the slips, to lift the stuck pipe from the well bore in the retrieval operation.

8 Claims, 3 Drawing Sheets

TO SHEET 2

FROM SHEET 1

MANUALLY OPERATED SPEAR APPARATUS

BACKGROUND OF THE INVENTION

1. Field of the Invention

This invention relates to fishing operations in oil wells and more particularly, to a spear assembly which is designed for use within a landing joint or sleeve and within one or more lengths of wash-over pipe to retrieve lost tools and engage and free pipe and other objects, commonly known as "fish", lodged in a well bore. The manually operated spear apparatus is characterized by a landing joint having spaced windows, which landing joint encases a spear assembly having a set of spaced lugs for engaging the windows to facilitate initial attachment of the spear assembly to the fish, disengagement of the lugs from the windows and lowering the wash-over pipe over the stationary spear assembly to "wash over" the "fish", in the well bore. The spear apparatus further includes a set of slips for selectively engaging the wash-over pipe, in order to remove the wash-over pipe, landing joint, spear assembly and "fish" from the well bore. The spear apparatus is lowered along with the landing joint and a string of wash pipe inside the well bore, by means of a conventional "fish string", which is attached to the wash-over pipe. After engagement with the "fish" by the spear apparatus is effected, rotation of the "fish string", the wash-over pipe and the landing joint to the left, for example, in the counterclockwise direction when facing the well bore, facilitates disengagement of the spaced lugs with the corresponding windows in the landing joint and continued movement of the wash-over pipe downwardly concentrically around the spear apparatus, into the well bore, to complete the "wash-over" operation. Raising of the "fish string" and the wash-over pipe facilitates engagement of the slips against the inside surface of the wash-over pipe and allows removal of the wash-over pipe, the spear apparatus and the freed "fish" from the well bore.

One of the problems which exists in the drilling of oil and gas wells is that of losing drill string and other pipe, as well as various tools, in both cased and uncased wells. The retrieval of such material from a well bore is achieved in a procedure known as a "fishing operation", in which various retrieving tools are lowered on a "fish string" to engage and retrieve the lost tools or pipe. In some cases, pipe may become stuck or jammed in the well bore by impacted sand and a procedure known as a "wash-over" operation is necessary. During the "wash-over" procedure, multiple lengths of wash-over pipe are lowered into the well bore and are forced through the well bore past the stuck pipe by using a rotary shoe and/or pumping a fluid through the well bore to wash the sand from the stuck pipe, in order to facilitate retrieval of the pipe. Various types of tools may be utilized inside the wash-over pipe, in order to engage and retrieve the stuck pipe as the wash-over pipe functions to remove the sand from the pipe and the well bore around the pipe.

2. Description of the Prior Art

An early tool which is designed for removing a casing from within a well or for removing tools which may be dropped within the casing, is detailed in U.S. Pat. No. 1,243,904, dated Oct. 23, 1917, to W. Wagner. The "Casing Spear" detailed in this patent includes a tubular carrier provided with a socket having an engaging means and gripping jaws slidably engaged within the carrier. A mandrel is also positioned within the carrier and extends within the socket, the mandrel being provided with a longitudinally-disposed slot and a transverse pin is designed to engage the gripping jaws and is loosely directed through the slot of the mandrel. An expansible member is constantly urging the pin in one direction and a breakable means coacts with the carrier and the mandrel to normally maintain the mandrel against movement under the influence of the expansible member and to normally maintain the expansible member under compression. U.S. Pat. No. 2,595,014, dated Apr. 29, 1952, to L. W. Smith, et al, details a "Hydrostatic Pulling Tool for Wells". The pulling tool is adapted to be anchored in the casing of a well bore and to pull upwardly on a "fishing tool" which is connected to the lower end of the pulling tool when the fishing tool is connected to a lodged object in the well. An "Overshot Retrieving Tool" is detailed in U.S. Pat. No. 3,393,002, dated July 16, 1968, to B. J. Woolley. The overshot retrieving tool is designed for lowering into a well casing in an unlatched condition and may be released to grasp an object with a force that increases as the weight of the object is applied to the tool. The tool is so arranged that a downward, as well as a rotational force can be applied to the object while it is being gripped. U.S. Pat. No. 4,706,745, dated Nov. 17, 1987, to Thomas R. Bishop, et al, describes a "Lock-Down Release Spear Assembly". The assembly is designed for engaging a tubular member with a tension-type spear, wherein the spear is locked to the tubular member so that it is not released when compressive or other non-tension loads are applied to it. The assembly locks the spear to the tubular member through abutment of a transfer assembly connected to the spear-supporting mandrel after the spear has been set within the tubular member. The abutment of the transfer assembly and the tubular member lock the spear within the tubular member under tension, so that compressive or other non-tension loads applied to the supporting pipe string will not affect the grip of the spear. A "Wash-over Pipe Spear Apparatus" is detailed in U.S. Pat. No. 3,747,674, dated July 24, 1973, to William K. Murray. The apparatus is designed for automatically engaging and washing-over a pipe jammed in a well bore and includes a wash-over pipe, a retrieving assembly located within the wash-over pipe having means for engaging the stuck pipe, releasable latch means joining the retrieving assembly and the wash-over pipe, so that the assembly and pipe may be lowered into position, and a slip assembly. The retrieving assembly includes a releasable clutch which selectively controls setting of the slips and may be operated by vertical manipulation of the supporting tubing string.

It is an object of this invention to provide a manually-operated spear apparatus which is capable of retrieving various pipe, tools and objects that block well bores.

Another object of the invention is to provide a new and improved, manually-operated spear assembly for location inside a landing joint and wash-over pipe connected to the landing joint, and retrieving pipe and other "fish" lodged in the bore of a well.

Still another object of this invention is to provide a manually-operated spear apparatus which includes a spear assembly having a lug mechanism and a slip assembly and a landing joint enclosing the spear assembly, wherein the lug mechanism and slip assembly can be operated in the spear assembly by rotating the landing joint, to selectively release the landing joint from the spear assembly and engage and disengage the slips with the wash-over pipe, without placing undesirable stress on the fishing string.

Another object of the invention is to provide a manually-operated spear assembly which is capable of being suspended by means of a conventional fishing string inside a landing joint with one or more sections of wash-over pipe connected to the landing joint, in order to engage one or more lengths of down-hole pipe or other "fish" which may be lodged in the bore of a well, for removing the pipe or "fish", responsive to initial vertical manipulation of the wash-over pipe and the landing joint by means of the fishing string to engage the "fish", and subsequent rotational operation of the fishing string, wash-over pipe and landing joint to effect selective engagement and disengagement of the spear assembly within the wash-over pipe and landing joint, by first lowering the wash-over pipe and landing joint with respect to the spear assembly and then lifting the wash-over pipe, landing joint, spear assembly and "fish" from the well bore.

Another object of this invention is to provide a new and improved, manually operated spear apparatus for removing an object or "fish" from a well bore, which apparatus includes a spear assembly encased in a cylindrical landing joint sleeve which is provided with three internal sleeve windows and is adapted to receive a string of wash-over pipe suspended in the well bore by a fishing string, which spear assembly includes multiple spring-loaded lugs for initially engaging the sleeve windows and maintaining the spear assembly inside the landing joint while the spear assembly is attached to the "fish", and disengaging the sleeve windows responsive to rotation of the fishing string, wash-over pipe and landing joint with respect to the spear assembly, to enable lowering of the wash-over pipe around the stationary spear assembly and the "fish" to loosen the "fish" in the well bore. Further provided is a set of slips, a pair of J-slots and a pair of J-bolts located in the spear assembly, which J-bolts are adapted to selectively engage designated leg portions in the J-slots for extending the slips into engagement with the wash-over pipe and lifting the wash-over pipe, the landing joint, the spear assembly and the "fish" from the well bore, responsive to lifting of the fishing string.

SUMMARY OF THE INVENTION

These and other objects of the invention are provided in a landing joint-encased, manually-operated spear assembly which is characterized by manually rotationally-operated control lugs and slips, which lugs are capable of rotating inside corresponding windows in the landing joint and the slips are caused to engage a section of fishing string-supported wash-over pipe, respectively, responsive to sequential rotation of the wash-over pipe by the fishing string after engagement of the spear assembly with a "fish" located in the well bore, to facilitate initially lowering the wash-over pipe concentrically around the stationary spear assembly to clear the "fish" in conventional fashion and subsequently raising the wash-over pipe and engaging the slips with the inside surface of the wash-over pipe for removing the "fish" from the well bore.

BRIEF DESCRIPTION OF THE DRAWINGS

The invention will be better understood by reference to the accompanying drawings, wherein.

DESCRIPTION OF THE PREFERRED EMBODIMENTS

Figures 1, 4, 5, 6, 7:
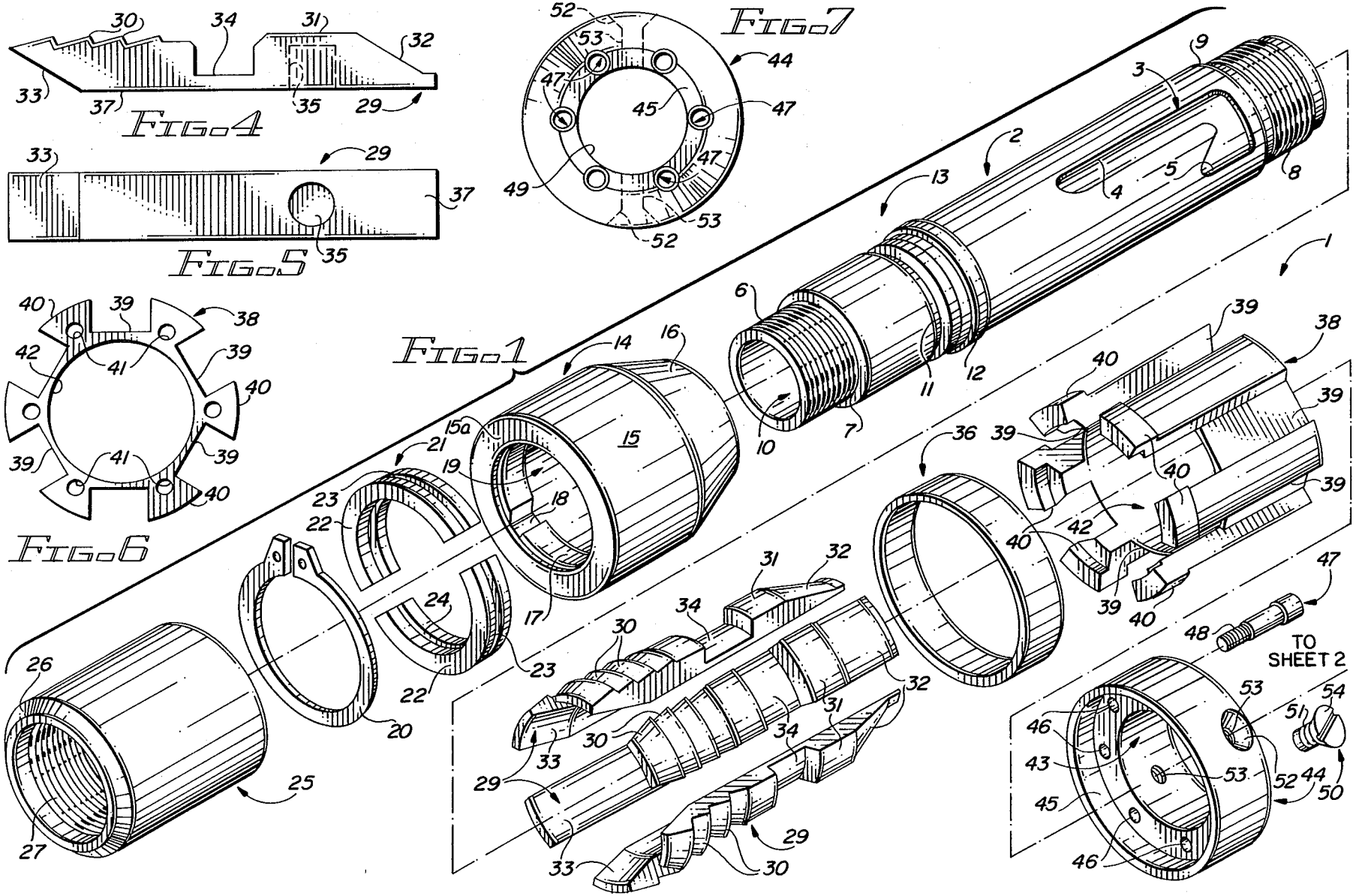
FIG. 1 is an exploded view of a preferred embodiment of the manually-operated spear assembly components of the manually-operated spear apparatus of this invention.
FIG. 4 is a side view of one of several slips arranged in radial relationship in the spear assembly illustrated in FIG. 1.
FIG. 5 is a bottom view of the slip illustrated in FIG. 4.
FIG. 6 is a bottom end view of a slip housing which receives and mounts the slips illustrated in FIGS. 1, 4 and 5.
FIG. 7 is a bottom end view of a slip housing cap which mounts on the bottom end of the slip housing illustrated in FIG. 1.
Figures 1, 2, 3, 8, 9, 10:
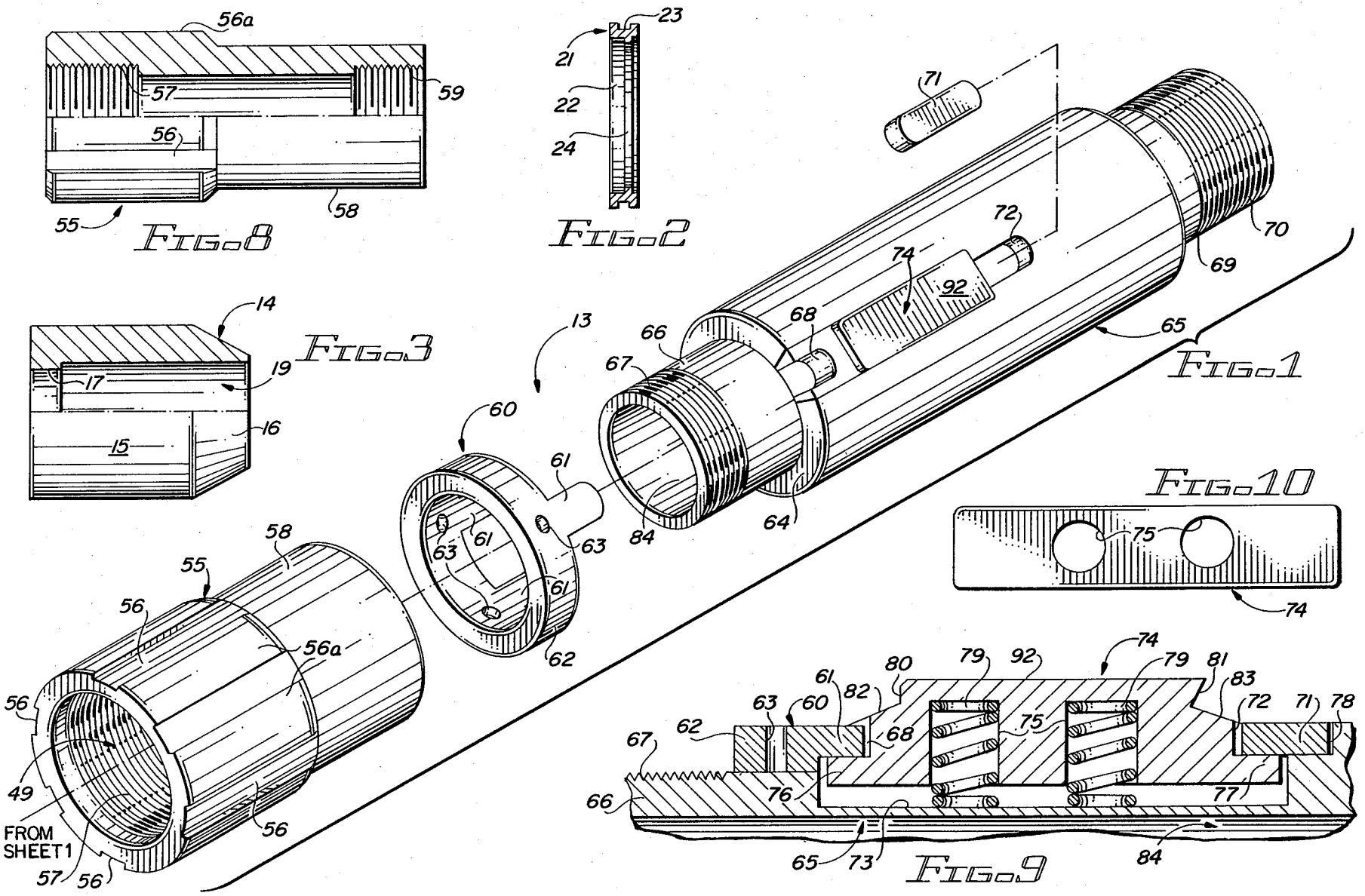
FIG. 2 is a sectional view of a split ring designed to join mandrel and slip cone components of the spear apparatus illustrated in FIG. 1.
FIG. 3 is a side view quarter-section of the slip cone component.
FIG. 8 is a side view quarter-section of a stabilizing bushing component of the spear assembly illustrated in FIG. 1.
FIG. 9 is a sectional view of one of three control lugs and control lug housing components of the spear assembly illustrated in FIG. 1.
FIG. 10 is a bottom view of the control lug illustrated in FIG. 9.
Figure 11:
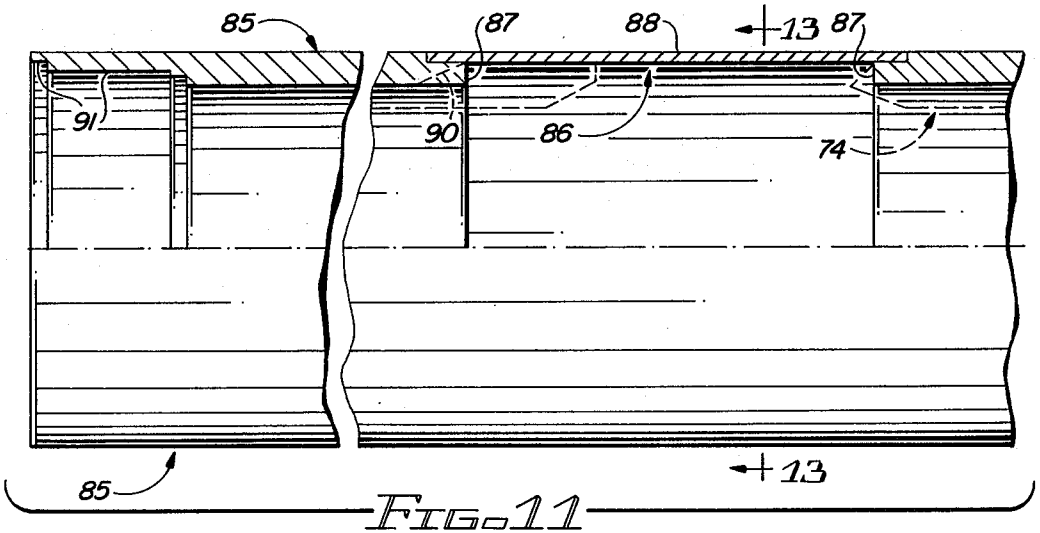
FIG. 11 is a side view quarter-section of that portion of the landing joint component of the spear apparatus which receives the control housing and control lugs.
Figure 12:
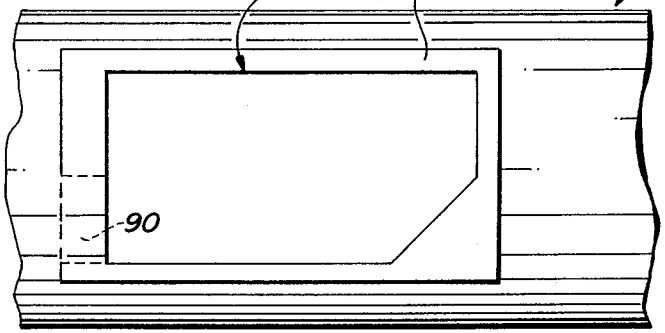
FIG. 12 is a top view, partially in section, of a landing joint window which receives one of three control lug plates for mounting the control lugs, respectively.
Figure 13:
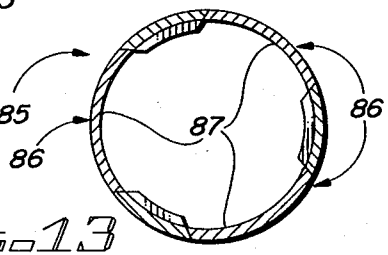
FIG. 13 is a reduced-size, sectional view taken along line 13—13 of the landing joint illustrated in FIG. 11.
Figure 14:
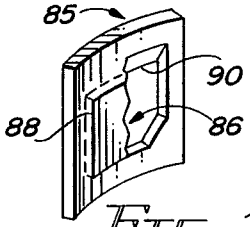
FIG. 14 is a perspective view of a section of the landing joint, more particularly illustrating the landing joint window and control lug plate which facilitate operation of the spear assembly illustrated in FIG. 1.
Figure 16:
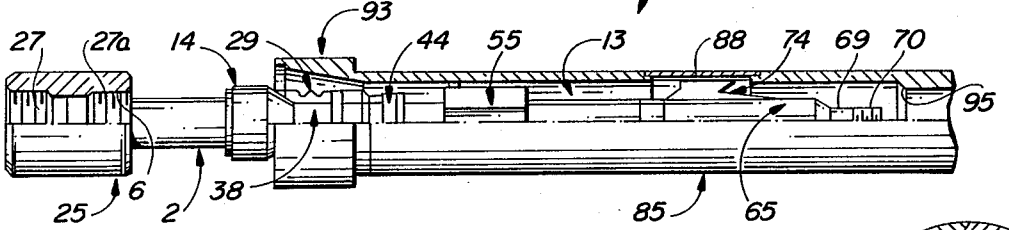
FIG. 16 is a side quarter section of a portion of the landing joint and split loading plug with the spear assembly assembled therein, illustrating the assembled manually-operated spear apparatus.

Referring initially to FIGS. 1–8 and 16 of the drawings, the manually operated spear apparatus of this invention is generally illustrated by reference numeral 1. The spear apparatus 1 is characterized by a spear assembly 13, illustrated in exploded view, and includes a cylindrically-shaped mandrel 2, which is provided with a pair of oppositely-disposed, longitudinal J-slots 3 in the sides thereof, each of which J-slots 3 is defined by a long leg 4 and a short leg 5. The mandrel 2 is terminated on the top end by mandrel outside threads 6, which extend to a mandrel outside shoulder 7 and the opposite, or bottom end of the mandrel 2 is fitted with mandrel inside threads 8, which are terminated by the mandrel outside shoulder 9. A mandrel bore 10 extends longitudinally through the mandrel 2 and a snap ring groove 11 and shear ring seat 12 are provided in spaced relationship in the mandrel 2, near the mandrel outside threads 6. A slip cone 14, illustrated in FIGS. 1 and 3, is provided with a cone body 15, having a cone bore 19 which is larger than the diameter of the mandrel 2 and is also fitted with an internal body lip 17, which engages the shear ring collar 12 when the slip cone 14 is assembled on the mandrel 2. A key slot 18 is provided in the body lip 17 of the cone body 15, in order to receive a key (not illustrated), which also engages a corresponding slot (not illustrated) provided in the shear ring collar 12 of the mandrel 2, in order to securely seat the cone body 15 of the slip cone 15 on the mandrel 2 in non-rotatable relationship. A body taper 16 is provided on the lower end of the cone body 15 for a purpose which will be hereinafter further described. The snap ring groove 11 is provided in the mandrel 2, in order to receive the split ring inside shoulder 24 of the matching ring segments 22 of a split ring 21, illustrated in FIGS. 1 and 2, and a snap ring 20 is designed to seat in the split ring outside groove 23 of the split ring 21, in order to secure the split ring 21 against the body face 15*a* of the cone body 15, and the slip cone 14 on the mandrel 2 in assembled configuration. The split ring shoulder 24 in the split ring 21 serves to prevent the slip cone 14 from sliding upwardly on the mandrel 2 when the snap ring 20 is locked in the split ring outside groove 23. A top sub 25 defines the top end of the spear assembly 13 and is provided with a top sub taper 26 at the top end thereof, interior top sub threads 27 for attachment to auxiliary equipment (not illustrated) and with interior bottom sub threads 27*a*, illustrated in FIG. 16, for receiving the mandrel outside threads 6 when the slip cone 14, split ring 21 and the snap ring 20 are assembled on the mandrel 2, as illustrated in FIG. 16. A slip housing 38, illustrated in FIGS. 1 and 6, is provided with spaced, longitudinal slip grooves 39 and companion keeper ring retainers 40 and the slip housing 38 is further provided with a slip housing bore 42, which, like the slip cone 14, is larger than the outside diameter of the mandrel 2. Accordingly, the slip housing 38 is designed to register in concentric relationship with the mandrel 2, over the J-slots 3 and below the slip cone 14 and multiple, spaced housing bolt holes 41 are provided longitudinally in the slip housing 38, as illustrated in FIG. 6, in order to receive the cap bolts 47, as hereinafter further described. As further illustrated in FIGS. 1, 4 and 5 of the drawings, multiple slips 29 are designed to seat in the slip grooves 39 of the slip housing 38, respectively, with each slip bottom 37 engaging a corresponding slip groove 39 and the slip teeth 30 projecting radially upwardly, but located radially beneath the perimeter of the keeper ring retainers 40, respectively. Each of the slips 29 is further provided with a slip ring groove 34, for receiving a keeper ring 36 that removably secures each of the slips 29 in the slip grooves 39 of the slip housing 38. A slip bottom taper 33 is shaped in the upper end of each of the slips 29, and faces the body taper 16 of the cone body 15, when the slip cone 14 and slip housing 38 are assembled on the mandrel 2 and the slips 29 are assembled on the slip housing 38 by means of the keeper ring 36. Each of the slips 29 is further provided with a rocker pad 31, having a slip top taper 32 at the rear end thereof, which slip top taper 32 extends from the rocker pad 31 to define the slip bottom end 28 of the slips 29. As further illustrated in FIGS. 1 and 7, a slip housing cap 44 is designed to enclose the bottom end of the slip housing 38 and is provided with a cap bore 43, defined by a cap shoulder 45, having multiple cap bolt holes 46, which extend in spaced relationship through the cap shoulder 45. The cap bolts 47 are fitted with cap bolt threads 48 and are designed to register with the respective cap bolt holes 46, located in the cap shoulder 45 of the slip housing cap 44 as illustrated in FIG. 7 and to threadably engage the internally threaded housing bolt holes 41, provided in the slip housing 38, in order to secure the slip housing cap 44 on the slip housing 38. A pair of cap countersinks 52 communicate with corresponding threaded countersink bores 53, provided in oppositely-disposed relationship in the slip housing cap 44 and are designed to receive a pair of J-bolts 50, each having slotted heads 54 and J-bolt threads 51. The J-bolts 50 are designed to threadably engage internal threads provided in the countersink bores 53 and to extend through the inside perimeter of the cap shoulder 45 into the cap bore 43 in facing relationship, and selectively engage the long leg 4 and the short leg 5 of the J-slots 3, respectively. Accordingly, it will be appreciated that the slip housing 38, slips 29 and the slip housing cap 44 are slidably disposed on the mandrel 2 as the projecting ends of the J-bolts 50 slidably extend into the long leg 4 and short leg 5 of the J-slots 3, respectively, responsive to operation of the spear assembly 13, as hereinafter further described.

Referring now to FIGS. 1 and 8 of the drawings, a cylindrical stabilizing bushing 55 is fitted with spaced, alternating stabilizing bushing grooves 56 in the surface thereof, which stabilizing bushing grooves define spaced stabilizing plates 56*a*. The stabilizing bushing 55 is further provided with internal stabilizing bushing threads 57, fitted in the top segment of the stabilizing bushing bore 49. A stabilizing bushing nipple 58, provided with internal stabilizing bushing nipple threads 59, extends from the bottom end of the stabilizing bushing 55 and is designed to threadably receive a lug ring receiving nipple 66, provided with external receiving nipple threads 67, located in a companion control lug housing 65. Accordingly, the receiving nipple threads 67 are designed to engage the stabilizing bushing threads 57 when the stabilizing bushing 55 is assembled on the control lug housing 65, which is provided with a control lug housing bore 84, as hereinafter further described. A keeper lug ring 60 is sandwiched between the stabilizing bushing nipple 58 of the stabilizing bushing 55 and the control lug housing shoulder 64 of the control lug housing 65. Assembly of the keeper lug ring 60 on the lug ring receiving nipple 66 projects three keeper lugs 61, extending in spaced relationship from the lug ring 62 of the keeper lug ring 60, into corresponding keeper lug slots 68, provided in spaced relationship in the control lug housing shoulder 64 of the control lug housing 65 and the top ends of three control lugs 74, respectively. A fish nipple 69 is provided on the opposite end of the control lug housing 65 from the lug ring receiving nipple 66 and is provided with external fish nipple threads 70, for attachment to a "fish" (not illustrated) which may be jammed or stuck in the well bore of a well (not illustrated). The control lug housing 65 terminates the bottom end of the spear assembly 13 and the stabilizing plates 56*a* are designed to fit in close tolerance inside the landing joint 85, as illustrated in FIG. 16, in order to stabilize the spear assembly 13 in the landing joint 85. The lug ring 62 is provided with multiple, spaced, threaded set screw seats 63 at the keeper lugs 61, respectively, for receiving companion set screws (not illustrated), in order to secure the keeper lug ring 60 on the lug ring receiving nipple 66 in assembled configuration. Retainer lugs 71 are welded into position in retainer lug slots 72, provided in the control lug housing 65, in order to secure each of three control lugs 74 in corresponding control lug slots 73, provided in the control lug housing 65, as illustrated in FIGS. 1 and 9. Each of the control lugs 74 is provided with a pair of spaced spring seats 75, for receiving a pair of control lug springs 79, as illustrated in FIG. 9. Each control lug 74 further includes a keeper lug flange 76 at the top end thereof and a corresponding retainer lug flange 77 at the bottom end, which keeper lug flange 76 is retained in position in the control lug slot 73 by means of the keeper lug 61, and the retainer lug flange 77 is maintained inside the control lug slot 73 by means of the retainer lug 71. In a preferred embodiment of the invention, the retainer lug 71 is maintained in position in the lug ring receiving nipple 66 by means of a weld 78, in order to initially position each of the control lugs 74 in the respective control lug slots 73. A control lug wear pad 92 defines the top surface of each of the control lugs 74 and a control lug top shoulder 80 extends downwardly at a 90 degree angle from the respective control lug wear pads 92 on the top edges thereof. A top shoulder bevel 82 extends from the base of each of the control lug top shoulders 80 to the corresponding keeper lug flange 76 and the keeper lug slots 68 each extend into the top portion of the control lug 74 at the corresponding top shoulder bevel 82, in order to receive the keeper lug 61 of the keeper lug 60, as illustrated in FIGS. 1 and 9. A control lug bottom shoulder 81 projects inwardly of each of the control lugs 74 at the bottom edge thereof from the control lug wear pads 92, respectively, and a bottom shoulder bevel 83 extends in angular relationship from the base of the control lug bottom shoulder 81, as further illustrated in FIG. 9. A retainer lug slot 72 is provided in the bottom segment of the control lug 74 at the bottom shoulder bevel 83 and receives one end of the retainer lug 71, as further illustrated in FIG. 9.

Figure 15:
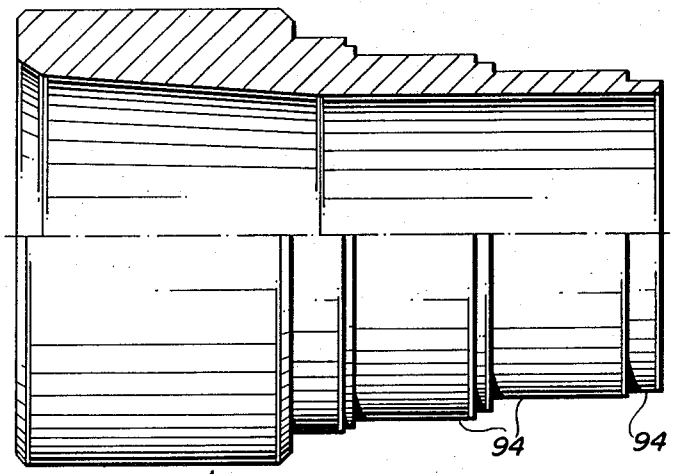
FIG. 15 is a side view quarter section of a split loading plug used for loading the spear assembly inside the landing joint.

Referring now to FIGS. 11–16 of the drawings, the mandrel 2, slip cone 14, slips 29, slip housing 38, slip housing cap 44, stabilizing bushing 55, keeper lug ring 60, control lug housing 65 and control lugs 74 are illustrated in assembled configuration inside a specially-designed landing joint 85, which is used to deploy the spear apparatus 1 in a well bore. The landing joint 85 includes three radially spaced landing joint windows 86, as further illustrated in FIGS. 11–14, each defined by a window flange 87 and having a plate recess 89. The plate recesses 89 are each designed to receive a control lug plate 88, which is, in turn, designed to contact the respective control lug wear pads 92 of each of the control lugs 74, when the control lugs 74 are installed in the respective control lug slots 73 of the control lug housing 65, as illustrated in FIG. 9. As further illustrated in FIGS. 12 and 14, each landing joint window 86 is provided with a landing joint bevel 90 in a segment of the top edge thereof, for receiving the control lug top shoulder 80, of each of the control lugs 74, when the landing joint 85 is rotated with respect to the spear assembly 13, as hereinafter further described. As illustrated in FIG. 15, a split loading plug 93 is provided with external two-step or "hydril" threads 94, for engaging corresponding internal two-step hydril threads 91 provided in the top end of the landing joint 85, in order to removably secure the split loading plug 93 to the landing joint 85. The spear apparatus 1 is assembled as illustrated in FIG. 16, with the spear assembly 13 located inside the landing joint 85 using the split loading plug 93, for functional operation. A landing joint shoulder 95 is shaped in the inside wall of the landing joint 85 immediately below the fish nipple 69, in order to receive the stabilizing plates **56*a*, provided in the stabilizing bushing 55, and prevent the spear assembly 13 from exiting the lower end of the landing joint 85 during the fishing operation, as hereinafter further described. The split loading plug 93 can then be removed and a fishing string (not illustrated) secured to a length of wash-over pipe (not illustrated), after which, the spear apparatus 1** may be lowered into a well bore in a fishing operation, as follows.

In operation, the spear assembly 13 is first extended through the split loading plug 93 and is located inside the landing joint 85 to assemble the spear apparatus 1 as illustrated in FIG. 16. The split loading plug 93 is then removed from the top end of the landing joint 85 and a string of wash-over pipe (not illustrated) of selected length is attached to the external 2-step hydril threads 94 of the landing joint 85. A rotary shoe (not illustrated) may be attached to the bottom end of the landing joint 85, in order to aid in the cutting and wash-over operation, as deemed necessary. A fishing string (not illustrated) is then attached to the wash-over pipe in conventional fashion and the wash-over pipe, landing joint 85 and the enclosed spear assembly 13 is lowered by means of the conventional "fishing string" inside a well bore (not illustrated) to the depth of a "fish", such as one or more lengths of pipe stuck or jammed in the well bore. Since the "fish" typically includes a pipe having female fitting extending upwardly in the well bore facing the spear assembly 13, the wash-over pipe is then rotated, along with the landing joint 85 and the spear assembly 13, to the right several revolutions by operation of the fish string, to threadably engage the fish nipple threads 70, located on the fish nipple 69, with the threaded "fish" which is stuck in the well bore. The spear assembly 13 rotates with the landing joint 85 and the wash pipe, since the top segments of the control lugs 74 project into the landing joint windows 86, respectively, with the control lug wear pads 92 engaging the respective control lug plates 88. When the fish nipple 69 and the spear apparatus 1 are connected to the jammed "fish", the fishing string, wash-over pipe and landing joint 85 are then rotated to the left, or in the counterclockwise direction as viewed from the top of the well bore, one-quarter to one-half of a revolution, to align the control lug top shoulders 80 with the respective landing joint bevels 90, illustrated in FIGS. 11, 12 and 14, and the fishing string is lowered, which action allows the control lugs 74 to engage the landing joint bevels 90, respectively, and depress inwardly of the landing joint 85 against the tension in the control lug springs 79, from the landing joint windows 86. Accordingly, the landing joint 85 and connected wash-over pipe can then be lowered concentrically around the stationary spear assembly 13 and the stuck "fish", to begin the wash-over operation. Fluid may then be pumped through the wash-over pipe and the landing joint to wash accumulated sand and shale from around the "fish", in order to free the "fish". Alternatively, fluid may be pumped through the wash-over pipe and the interior of the spear assembly 13 and flushed upwardly around the well bore and back through the landing joint 85 and the wash-over pipe, to free the jammed "fish". Still further in the alternative, the wash-over pipe and landing joint 85 can be continuously rotated around the stationary spear assembly 13, to facilitate cutting sand, shale, silt and other accumulated material from the stuck pipe by operation of a rotary shoe (not illustrated) which may be attached to the bottom end of the landing joint 85. When the wash-over operation is complete, the freed pipe, spear assembly 13, wash-over pipe and landing joint 85 can be removed from the well bore by lifting the fishing string, wash-over pipe and landing joint 85. Since the wash-over pipe and landing joint 85 have been previously rotated one-fourth to one-half turn to the left by rotary manipulation of the fishing string to disengage the control lugs 74 from the respective landing joint windows 86, this action also causes the extending ends of the J-bolts 50, which are slidably mounted in the slip housing cap 44, to traverse the short leg 5 of the J-slot 3 and engage the long leg 4. Accordingly, lifting of the fishing string upwardly facilitates upward movement of the slip housing cap 44, slip housing 38 and the J-bolts 50 in the long leg 4 of the J-slot 3, along with upward movement of the slips 29 with respect to the mandrel 2 and the slip cone 14, such that the slip bottom taper 33 of each of the slips 29 engages the body taper 16 of the slip cone 14. Continued movement of the slips 29 upwardly against the bottom taper 16 of the cone body 15 causes the slips 29 to move radially outwardly, such that the slip teeth 30 engage and tighten against the inside surface of the wash-over pipe and secure the spear assembly 13 inside the wash-over pipe. Continued upward pressure applied to the fishing string tightens the slip teeth 30 inside the wash-over pipe and further secures the spear assembly 13, such that the spear apparatus 1, wash-over pipe and the landing joint 85, as well as the freed "fish", can be removed from the well bore. In the event that the "fish" is not yet freed from the well bore and remains jammed, the fishing string can then be lowered and rotated one-quarter to one-half turn back to the right in the clockwise direction as the well bore is viewed from the top, such that tension is released on the fishing string, causing the J-bolts 50 to first traverse the long leg 4 of the J-slots 3 in the opposite direction and again seat in the short leg 5. This action causes the slips 29 to move downwardly on the bottom taper 16 of the cone body 15 and the slip housing cap 44 to assume its original position, with the slips 29 oriented in radially retracted configuration in the slip housing 38 and the slip teeth 30 spaced from the inside surface of the wash-over pipe. Accordingly, the spear assembly 13 is now in position to allow continued downward deployment of the landing joint 85 and the string of wash-over pipe around the "fish" to commence another washing operation to free the stuck pipe. Alternatively, various other procedures such as "jarring down" and "jarring up" using bumper jars and oil jars, respectively, and like methods, may be used to free the stuck "fish", according to the knowledge of those skilled in the art. The above described procedure is then repeated until the pipe is freed from the well bore and is lifted from the well bore. Referring again to FIGS. 1, 8 and 16 of the drawings, after the spear assembly 13 is attached to the "fish", if the "fish" should fall in the well bore, the spear assembly 13 will be displaced downwardly in the landing joint 85 until the stabilizing plates **56*a* in the stabilizing busing 55 engage the landing joint shoulder 95, thus preventing loss of the spear assembly 13** in the well bore.

It will be appreciated by those skilled in the art that the manually-operated spear apparatus 1 of this invention can be used in both open hole and cased hole fishing operations and that wire line tools of various description, including explosive cord, can be lowered through the center of the spear assembly 13 of the spear apparatus 1, in order to effect various desired operations, such as controlled back-off procedures. One of the primary advantages of the spear apparatus of this invention is the facility for minimizing shock on the fishing string when the fishing string is rotated to the left and raised, in order to facilitate engagement of the slips 29 with the inside of the wash-over pipe. Since the length of the long leg 4 of the J-slots 3 is only about three or four inches, the spear apparatus 1 will drop only this distance when the locking operation is initiated. Furthermore, as illustrated in FIG. 16 and as described above, the landing joint shoulder 85, built into the wall of the landing joint 85, prevents the spear assembly 13 from dropping through the landing joint 85 if the "fish" should suddenly and unexpectedly loosen and drop in the well bore after attachment to the spear assembly 13.

It will be further appreciated that the manually operated spear apparatus of this invention can be designed for use with wash-over pipe having any desired wall thickness to recover such items as lost pipe, drill collars, tools, packers and bit cones, in non-exclusive particular. Furthermore, referring again to FIG. 1 of the drawings, while the J-slots 3 provided in the mandrel 2 are "left hand sets" as described above, it is understood that the positions of the J-slots 3 can be reversed, to facilitate automatic setting of the slips 29 if the "fish" should fall in the well bore after the spear assembly 13 is attached to the fish. This self-locking procedure would occur, since the J-bolts 50 would be disposed initially in the long leg 4, instead of the short leg 5, before any rotational adjustment of the fishing string, wash-over pipe and landing joint 85 is effected.

Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A manually operated spear apparatus for removing an object from a well bore, comprising an outer sleeve having three internal windows disposed in spaced relationship in said outer sleeve, said outer sleeve adapted for attachment to a string of wash-over pipe, wherein the outer sleeve and the wash-over pipe are supported in a well bore by a fishing string connected to the wash-over pipe, and a spear assembly adapted for disposition inside said outer sleeve and the wash-over pipe, said spear assembly further comprising a cylindrical mandrel provided with connecting means for removably connecting said cylindrical mandrel to the object; a slip cone carried by said cylindrical mandrel, said slip cone having a tapered body portion; a control lug housing carried by said cylindrical mandrel, bias means provided in said control lug housing and three control lugs disposed in spaced relationship in said control lug housing in alignment with said internal windows, respectively, said control lugs adapted for selectively engaging said windows in said outer sleeve and retaining said spear assembly in said outer sleeve in well insertion configuration, and disengaging said windows and releasing said spear assembly from said outer sleeve in operational configuration responsive to attachment of said spear assembly to the object in the well bore and rotation of the fishing string and lowering of the fishing string, the outer sleeve and the wash-over pipe in the well bore with respect to the spear assembly; a stabilizing bushing threadably carried by said cylindrical mandrel and said control lug housing and a keeper lug ring carried by said control lug housing and engaging said control lugs for maintaining said control lugs in said control lug housing; and further comprising a pair of J-slots provided in oppositely-disposed relationship in said cylindrical mandrel, said J-slots each having a first leg segment and a second leg segment connected to said first leg segment, a slip housing slidably mounted on said cylindrical mandrel, a plurality of slips seated in said slip housing and a pair of J-bolts disposed in said slip housing, said J-bolts adapted for selectively engaging said first leg segment and said second leg segment of said J-slots and retaining said slips in said slip housing in said well insertion configuration, and extending said slips in said slip housing responsive to rotation of the fishing string and raising of the fishing string in the well bore, in said operational configuration.

2. The manually operated spear apparatus of claim 1 wherein, said slips are each provided with a bottom taper facing said tapered body portion of said slip cone, whereby said bottom taper in said slips engage said tapered body portion of said slip cone and said slips engage said outer sleeve to retain said spear assembly in the wash-over pipe when said J-bolts engage and traverse a selective one of said first leg segment and said second leg segment of said J-slots, respectively.

3. The manually operated spear apparatus of claim 1 wherein said connection means further comprises threads provided on said cylindrical mandrel.

4. A manually-operated spear apparatus for removing an object from a well bore, comprising a landing joint having three internal windows disposed in spaced relationship in said landing joint and adapted to receive a string of wash-over pipe of selected length for disposition in a well bore by means of a fishing string, and a spear assembly disposed within said landing joint, said spear assembly further comprising:

(a) lug means normally engaging said internal windows in said landing joint for securing said spear assembly in said landing joint;

(b) a cylindrical mandrel, a slip cone carried by one end of said cylindrical mandrel in fixed relationship, said slip cone provided with a tapered body portion; a control lug housing carried by said cylindrical mandrel, bias means provided in said control lug housing, said lug means disposed in said control lug housing in alignment with said internal windows, respectively, and wherein said lug means are radially and slidably seated in said control lug housing against said bias means, whereby said lug means are normally biased outwardly of said control lug housing against said windows provided in said landing joint for locking said spear assembly in said landing joint; a stabilizing bushing threadably carried by said cylindrical mandrel and said control lug housing and a keeper lug ring carried by said control lug housing and engaging said lug means for maintaining said lug means in said control lug housing, a pair of J-slots provided in oppositely-disposed relationship in said cylindrical mandrel, said J-slots having a first leg and a second leg connected to said first leg; a slip housing slidably mounted on said cylindrical mandrel, a plurality of slips mounted in said slip housing and a pair of J-bolts carried by said slip housing in spaced relationship and adapted to engage said J-slots, respectively, said J-bolts adapted for normally engaging said first leg in said J-slots and locking said slips in retracted configuration in said slip housing;

(c) threads provided on said cylindrical mandrel for removably connecting said cylindrical mandrel to the object lodged in the well bore, whereby said lug means disengage said windows and said landing joint and the wash-over pipe descend in the well bore with respect to said spear assembly when said cylindrical mandrel is attached to the object and the fishing string is rotated in a selected direction and lowered in the well bore, and said J-bolts shift from said first leg to said second leg of said J-slots and said slips engage the wash-over pipe for removing said spear assembly, said landing joint and the wash-over pipe from the well bore, when the fishing string is rotated in said selected direction and raised in the well bore.

5. The manually-operated spear apparatus of claim 4 wherein said slips are each provided with the bottom taper facing said tapered body portion of said slip cone, whereby said bottom taper engages said tapered body portion and said slips radially engage the wash-over pipe when said J-bolts engage second legs of said J-slots, respectively.

6. The manually operated spear apparatus of claim 4 wherein said connection means further comprises threads provided on one end of said cylindrical mandrel.

7. A manually-operated spear apparatus for removing an object from the bore of a well, comprising a landing joint having a plurality of internal windows and a bevel provided in each of said internal windows, said landing joint adapted for connection to a string of wash-over pipe of selected length for disposition in a well bore by means of a fishing string, and a spear assembly disposed within said landing joint, said spear assembly further comprising:

(a) a cylindrical mandrel and a slip cone carried by one end of said cylindrical mandrel in fixed relationship, said slip cone having a tapered body portion;

(b) a plurality of lug means carried by said cylindrical mandrel, said lug means normally engaging internal windows in said landing joint, respectively, for removably securing said spear assembly in said landing joint; a control lug housing carried by said cylindrical mandrel; a stabilizing bushing threadably carried by said cylindrical mandrel and said control lug housing; and a keeper lug ring carried by said control lug housing and engaging each of said lug means, for maintaining said lug means in said control lug housing;

(c) a pair of J-slots provided in oppositely-disposed relationship in said cylindrical mandrel, said J-slots having a first leg and a second leg connected to said first leg, a slip housing slidably mounted on said cylindrical mandrel, a plurality of slips seated in said slip housing and a pair of J-bolts carried by said slip housing, said J-bolts adapted for normally engaging said first leg in said J-slots and controlling the extension and retraction of said slips in said slip housing; and (d) threads carried by said cylindrical mandrel for removably connecting said cylindrical mandrel to the object lodged in the well bore, whereby said lug means engage said bevel and disengage said windows, respectively, and said landing joint and the wash-over pipe descend in the well bore with respect to said spear assembly when said cylindrical mandrel is attached to the object and the fishing string is rotated in a selected direction and lowered in the well bore, and said J-bolts shift from said first leg to said second leg of said J-bolts and said slips engage the wash-over pipe for removing said spear assembly, said landing joint and the wash-over pipe from said well bore, when the fishing string is rotated in said selected direction and raised in the well bore.

8. The manually operated spear apparatus of claim 7 wherein said slips are each provided with a bottom taper facing said tapered body portion of said slip cone, whereby said bottom taper in said slips engage said tapered body portion of said slip cone and said slips engage said landing joint when said J-bolts engage said second legs of said J-slots, respectively.

* * * * *